US009025792B2

(12) United States Patent
Eastty

(10) Patent No.: US 9,025,792 B2
(45) Date of Patent: May 5, 2015

(54) DETERMINING A CONFIGURATION FOR AN AUDIO PROCESSING OPERATION

(75) Inventor: Peter Charles Eastty, Eynsham (GB)

(73) Assignee: Oxford Digital Limited, Oxfordshire (GB)

( * ) Notice: Subject to any disclaimer, the term of this patent is extended or adjusted under 35 U.S.C. 154(b) by 323 days.

(21) Appl. No.: 13/519,966

(22) PCT Filed: Oct. 7, 2010

(86) PCT No.: PCT/GB2010/001882

§ 371 (c)(1),
(2), (4) Date: Dec. 26, 2012

(87) PCT Pub. No.: WO2011/080499

PCT Pub. Date: Jul. 7, 2011

(65) Prior Publication Data

US 2013/0114830 A1 May 9, 2013

(30) Foreign Application Priority Data

Dec. 30, 2009 (GB) ..... 0922702.6

(51) Int. Cl.

| | |
|---|---|
| ***H03G 5/00*** | (2006.01) |
| ***H04R 3/06*** | (2006.01) |
| ***H04S 7/00*** | (2006.01) |
| ***H04S 3/00*** | (2006.01) |

(52) U.S. Cl.

CPC ..... *H04R 3/06* (2013.01); *H04S 7/301* (2013.01); *H04S 3/00* (2013.01); *H04R 2205/024* (2013.01)

(58) Field of Classification Search

CPC ..... H04R 3/04; H03G 5/165; H03G 5/005

USPC ..... 381/103, 97, 98

See application file for complete search history.

(56) References Cited

U.S. PATENT DOCUMENTS

| | | | | |
|---|---|---|---|---|
| 5,581,621 | A | 12/1996 | Koyama | |
| 7,009,533 | B1 * | 3/2006 | Wegener | 341/76 |
| 2003/0063763 | A1 | 4/2003 | Allred et al. | |
| 2005/0031117 | A1 * | 2/2005 | Browning et al. | 379/391 |
| 2006/0153404 | A1 * | 7/2006 | Gardner | 381/103 |
| 2007/0025559 | A1 | 2/2007 | Mihelich | |

FOREIGN PATENT DOCUMENTS

| | | |
|---|---|---|
| EP | 1001652 | 5/2000 |
| EP | 1843635 | 10/2007 |

(Continued)

*Primary Examiner* — Alexander Jamal

(74) *Attorney, Agent, or Firm* — Antonio Papageorgiou, Esq.; Meister Seelig & Fein LLP

(57) ABSTRACT

A computer-implemented method of determining a configuration for an audio processing operation, wherein the audio processing operation comprises a predetermined set of one or more audio processing sub-operations, each audio processing sub-operation being configurable with one or more respective configuration parameters, the method comprising: specifying the predetermined set of one or more audio processing sub-operations; specifying a target frequency response; and performing a convergent optimization process to determine a configuration for the audio processing operation that reduces a difference between the frequency response of the audio processing operation and the target frequency response, wherein the configuration comprises a respective value for each configuration parameter of each audio processing sub-operation.

21 Claims, 7 Drawing Sheets

(56) References Cited

FOREIGN PATENT DOCUMENTS

| | | |
|---|---|---|
| EP | 1986466 | 10/2008 |
| JP | 2008/507244 | 3/2008 |
| WO | 2007106872 | 9/2007 |
| WO | 2008097595 | 8/2008 |

* cited by examiner

DETERMINING A CONFIGURATION FOR AN AUDIO PROCESSING OPERATION

FIELD OF THE INVENTION

The present invention relates to a method of determining a configuration for an audio processing operation; a method of configuring a target device; and an apparatus and computer program arranged to carry out such method.

BACKGROUND OF THE INVENTION

As the size and form-factor of consumer equipment (such as handsets, mobile telephones, personal audio players, radios, satellite navigation devices, televisions, home cinema systems, etc) becomes smaller, it is becoming increasingly difficult to maintain the sonic performance at a reasonable level due to the use of small or micro speakers in such equipment, especially as these speakers are often housed into small acoustic enclosures. The resulting loss of acoustic performance often includes one or more of the following:

- "Honky" performance due to resonances within the speaker/enclosure combination and poor cabinet damping;
- Poor bass response due to use of small speakers, speaker apertures and enclosures;
- Inability to reproduce adequate loudness due to use of low battery voltages and small speakers in portable/mobile equipment;
- Difficulty in listening to material in noisy environments due to excessive dynamic range;
- A reduced stereo image due to pairs of speakers being very close together; and
- Speech intelligibility may be lost or severely degraded.

Tuning such devices can be a long and challenging task, often requiring the skills of a "golden ear" expert. It would be desirable to be able to reduce the time required and the skill level required for such tuning processes.

Moreover, there is often a limitation or restriction on the amount of processing (e.g. the amount of second order filter sections) available for the audio processing. This is particularly true when power consumption by, and size of, processing apparatus are to be kept as low as possible. Hence, it would be desirable to be able to improve the audio quality achievable from such a limited processing capability. It would also be desirable to be able to provide quick and simple means for being able to configure such a limited processing capability to achieve a desired audio processing result whilst adhering to the limitations imposed on the processing resources available.

SUMMARY OF THE INVENTION

According to a first aspect of the invention, there is provided a computer-implemented method of determining a configuration for an audio processing operation, wherein the audio processing operation comprises a predetermined set of one or more audio processing sub-operations, each audio processing sub-operation being configurable with one or more respective configuration parameters, the method comprising: specifying the predetermined set of one or more audio processing sub-operations; specifying a target frequency response; and performing a convergent optimization process to determine a configuration for the audio processing operation that reduces a difference between the frequency response of the audio processing operation and the target frequency response, wherein the configuration comprises a respective value for each configuration parameter of each audio processing sub-operation.

In this way, given a particular processing budget (e.g. an amount of resources on a digital signal processor), a configuration for a particular audio processing operating may be determined automatically so as to best match a target frequency response.

Specifying the target frequency response may comprise: specifying a plurality of initial frequency responses; and combining the initial frequency responses to form the target frequency response. In this way, a single target frequency response may be calculated and used for the optimization process. By combining multiple initial frequency responses (i.e. combining multiple audio effects) fewer audio processing resources are required in comparison, say, to using a first audio processing operation to achieve/apply a first effect (i.e. a first target frequency response), followed by using a second audio processing operation to achieve/apply a second effect (i.e. a second frequency response).

Specifying a plurality of initial frequency responses may comprise one or more of: (a) measuring a frequency response of an audio device or of a room and using the measured frequency response as an initial frequency response; (b) measuring a frequency response of an audio device or of a room and using an inverse of the measured frequency response as an initial frequency response; (c) using a predetermined frequency response as an initial frequency response; (d) allowing a user to modify a curve representing a frequency response to define a desired frequency response and using the desired frequency response as an initial frequency response; and (e) using the frequency response of an audio equalizer or of a combination of a plurality of audio equalizers as an initial frequency response.

Combining the initial frequency responses to form the target frequency response may comprise one or more of: weighting one or more of the initial frequency responses; adding at least two initial frequency responses; subtracting one initial frequency response from another initial frequency response; and using the frequency response defined by one initial frequency response over a first range of frequencies and using the frequency response defined by another initial frequency response over a second range of frequencies.

The specified target frequency response may be independent of the predetermined set of one or more audio processing sub-operations. In this way, a desired target frequency response may be provided that is much more complex (i.e. of a higher order) than actually achievable with the predetermined set of one or more audio processing sub-operations. However, the optimization process still attempts to determine a configuration for the audio processing operation, and will still converge on a configuration for the audio processing operation, that substantially approximates or best matches the target frequency response (at least as well as possible).

Performing a convergent optimization process may comprise: for an audio processing sub-operation: adjusting one or more control settings related to that audio processing sub-operation to reduce a difference between the frequency response of the audio processing operation and the target frequency response; and determining each configuration parameter of that audio processing sub-operation as a respective function of at least one of the one or more control settings related to that audio processing sub-operation. The use of control settings in this manner helps ensure that the optimization process converges and outputs a suitable configuration for the audio processing operation. In contrast, making adjustments directly on the configuration parameters often leads to unpredictable and chaotic changes of a frequency response, which would make performing the optimization process substantially more difficult and less likely to converge.

A control setting may correspond to an audio filter property adjustable by operation of an audio equalizer.

Preferably, for the or each control setting, a change in the frequency response of the respective audio processing sub-operation caused by adjusting that control setting is monotonically related to the adjustment of that control setting.

Preferably, for the or each control setting, adjusting that control setting causes a substantially localized change in the frequency response of the respective audio processing sub-operation.

Preferably, for the or each control setting, the magnitude of a change in the frequency response of the respective audio processing sub-operation caused by adjusting that control setting is substantially proportional to the magnitude of the adjustment of that control setting.

The method may comprise, after performing the convergent optimization process: allowing a user to modify the target frequency response; and performing the convergent optimization process based on the modified target frequency response. In this way, a user may interactively adjust the target frequency response and obtain new configurations for the audio processing operation accordingly—i.e. a user can fine tune the configuration as necessary.

In one embodiment, one of the one or more audio processing sub-operations is an overall gain adjustment.

In one embodiment, one or more of the one or more audio processing sub-operations are filter sections. The or each filter section may then be a second-order filter section having four configuration parameters and a predetermined overall gain—the use of such four-coefficient biquads helps reduce the amount of processing resources required and helps reduce the number of configuration parameters that need to be considered when performing the optimization process (thereby reducing the time required to carry out the optimization and helping ensure the optimization process will converge).

In one embodiment, the method also comprises: receiving input audio data; processing the input audio data using the audio processing operation configured according to the determined configuration; and outputting the processed input audio data. In this way, a user may listen to the sound effects resulting from the audio processing operation having been configured based on the configuration that has been determined from the optimization process. The method may then comprise, whilst performing the steps of receiving, processing and outputting: specifying a new target frequency response; and performing the convergent optimization process to determine a new configuration for the audio processing operation based on the new target frequency response, wherein the step of processing is then arranged to make use of the new configuration. In this way, a user can interactively adjust the target frequency response and listen to the results of the optimization process.

The difference between the frequency response of the audio processing operation and the target frequency response may be a root-mean-squared error.

The difference between the frequency response of the audio processing operation and the target frequency response may be measured over a user-defined set of frequencies.

According to another aspect of the invention, there is provided a computer-implemented method of determining a configuration for an audio processing operation, wherein the audio processing operation comprises a predetermined set of one or more audio processing sub-operations, each audio processing sub-operation being configurable with one or more respective configuration parameters, the method comprising: specifying the predetermined set of one or more audio processing sub-operations; specifying a target phase response; and performing a convergent optimization process to determine a configuration for the audio processing operation that reduces a difference between the phase response of the audio processing operation and the target phase response, wherein the configuration comprises a respective value for each configuration parameter of each audio processing sub-operation.

According to another aspect of the invention, there is provided a computer-implemented method of determining a configuration for an audio processing operation, wherein the audio processing operation comprises a predetermined set of one or more audio processing sub-operations, each audio processing sub-operation being configurable with one or more respective configuration parameters, the method comprising: specifying the predetermined set of one or more audio processing sub-operations; specifying a target frequency response; specifying a target phase response; and performing a convergent optimization process to determine a configuration for the audio processing operation that reduces (a) a difference between the frequency response of the audio processing operation and the target frequency response and (b) a difference between the phase response of the audio processing operation and the target phase response, wherein the configuration comprises a respective value for each configuration parameter of each audio processing sub-operation.

According to another aspect of the invention, there is provided a method of configuring a target device, the target device comprising an audio processing operation, wherein the audio processing operation comprises a predetermined set of one or more audio processing sub-operations, each audio processing sub-operation being configurable with one or more respective configuration parameters, the method comprising: determining a configuration for the audio processing operation using any one of the above methods; and applying the determined configuration to the audio processing operation of the target device.

According to another aspect of the invention, there is provided an apparatus comprising a processor, the processor being arranged to carry out any of the above methods.

According to another aspect of the invention, there is provided a computer program which, when executed by a computer, carries out any of the above methods. The computer program may be carried on a data carrying medium which may be a storage medium or a transmission medium.

BRIEF DESCRIPTION OF THE DRAWINGS

Embodiments of the invention will now be described, by way of example only, with reference to the accompanying drawings, in which.

DETAILED DESCRIPTION OF EMBODIMENTS OF THE INVENTION

In the description that follows and in the figures, certain embodiments of the invention are described. However, it will be appreciated that the invention is not limited to the embodiments that are described and that some embodiments may not include all of the features that are described below. It will be evident, however, that various modifications and changes may be made herein without departing from the broader spirit and scope of the invention as set forth in the appended claims.

Figure 1:
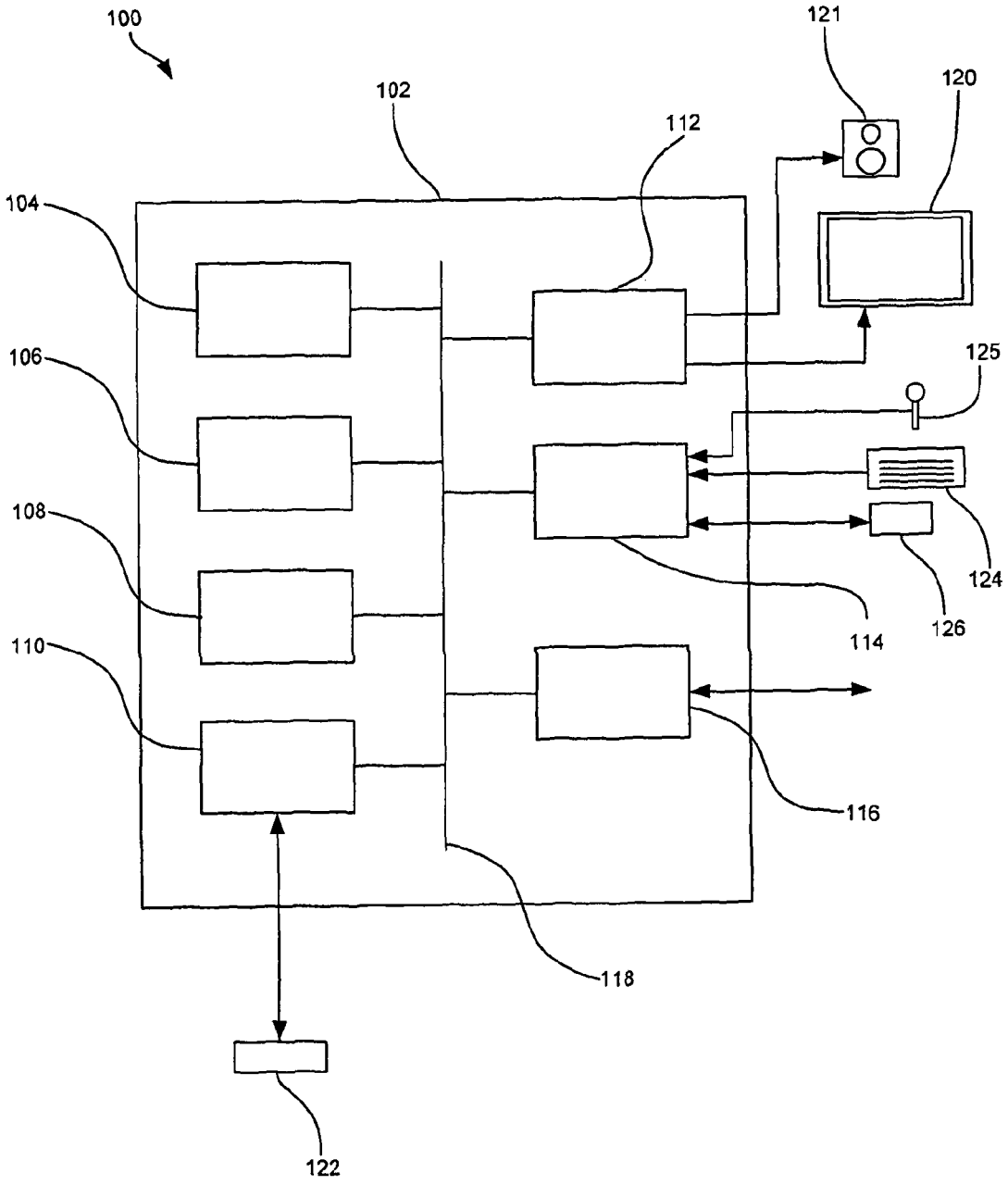
FIG. 1 schematically illustrates an example computer system according to an embodiment of the invention.

Embodiments of the invention may be executed by a computer system. FIG. 1 schematically illustrates an example computer system 100 according to an embodiment of the invention. The system 100 comprises a computer 102. The computer 102 comprises: a storage medium 104, a memory 106, a processor 108, a storage medium interface 110, an output interface 112, an input interface 114 and a network interface 116, which are all linked together over one or more communication buses 118.

The storage medium 104 may be any form of non-volatile data storage device such as one or more of a hard disk drive, a magnetic disc, an optical disc, a ROM, etc. The storage medium 104 may store an operating system for the processor 108 to execute in order for the computer 102 to function. The storage medium 104 may also store one or more computer programs (or software or instructions or code) that form part of an embodiment of the invention.

The memory 106 may be any random access memory (storage unit or volatile storage medium) suitable for storing data and/or computer programs (or software or instructions or code) that form part of an embodiment of the invention.

The processor 108 may be any data processing unit suitable for executing one or more computer programs (such as those stored on the storage medium 104 and/or in the memory 106) which have instructions that, when executed by the processor 108, cause the processor 108 to carry out a method according to an embodiment of the invention and configure the system 100 to be a system according to an embodiment of the invention. The processor 108 may comprise a single data processing unit or multiple data processing units operating in parallel, in cooperation with each other, or independently of each other. The processor 108, in carrying out data processing operations for embodiments of the invention, may store data to and/or read data from the storage medium 104 and/or the memory 106.

The storage medium interface 110 may be any unit for providing an interface to a data storage device 122 external to, or removable from, the computer 102. The data storage device 122 may be, for example, one or more of an optical disc, a magnetic disc, a solid-state-storage device, etc. The storage medium interface 110 may therefore read data from, or write data to, the data storage device 122 in accordance with one or more commands that it receives from the processor 108.

The input interface 114 is arranged to receive one or more inputs the system 100. For example, the input may comprise input received from a user, or operator, of the system 100; the input may comprise input received from a device external to or forming part of the system 100. A user may provide input via one or more input devices of the system 100, such as a mouse (or other pointing device) 126 and/or a keyboard 124, that are connected to, or in communication with, the input interface 114. However, it will be appreciated that the user may provide input to the computer 102 via one or more additional or alternative input devices. The system may comprise a microphone 125 (or other audio transceiver or audio input device) connected to, or in communication with, the input interface 114, the microphone 125 being capable of providing a signal to the input interface 114 that represents audio data (or an audio signal). The computer 102 may store the input received from the/each input device 124, 125, 126 via the input interface 114 in the memory 106 for the processor 108 to subsequently access and process, or may pass it straight to the processor 108, so that the processor 108 can respond to the input accordingly.

The output interface 112 may be arranged to provide a graphical/visual output to a user, or operator, of the system 100. As such, the processor 108 may be arranged to instruct the output interface 112 to form an image/video signal representing a desired graphical output, and to provide this signal to a monitor (or screen or display unit) 120 of the system 100 that is connected to the output interface 112. Additionally, or alternatively, the output interface 112 may be arranged to provide an audio output to a user, or operator, of the system 100. As such, the processor 108 may be arranged to instruct the output interface 112 to form an audio signal representing a desired audio output, and to provide this signal to one or more speakers 121 of the system 100 that is/are connected to the output interface 112.

Finally, the network interface 116 provides functionality for the computer 102 to download data from and/or upload data to one or more data communication networks (such as the Internet or a local area network).

It will be appreciated that the architecture of the system 100 illustrated in FIG. 1 and described above is merely exemplary and that other computer systems 100 with different architectures and additional and/or alternative components may be used in embodiments of the invention. For example, some or all of the input devices (e.g. the keyboard 124, the microphone 125 and the mouse 126) and/or the output devices (e.g. the monitor 120 and the speaker 121) may be integral with the computer 102, whilst others may be peripheral devices communicatively coupled to the computer 102 (e.g. via a cable and/or wirelessly).

Figure 2A:
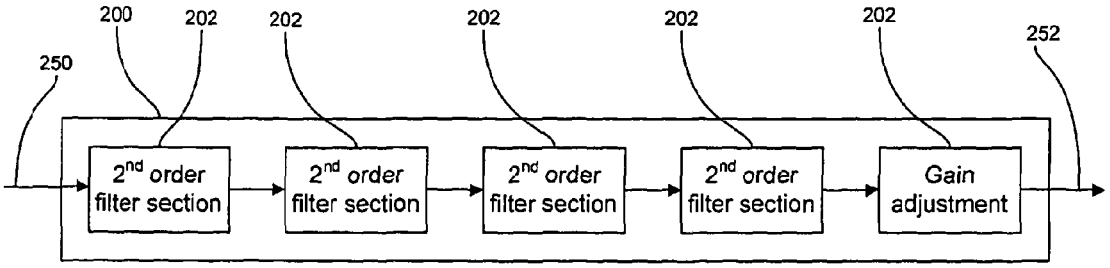
FIGS. 2*a*, 2*b* and 2*c* schematically illustrate example audio processing operations.
Figure 2B:
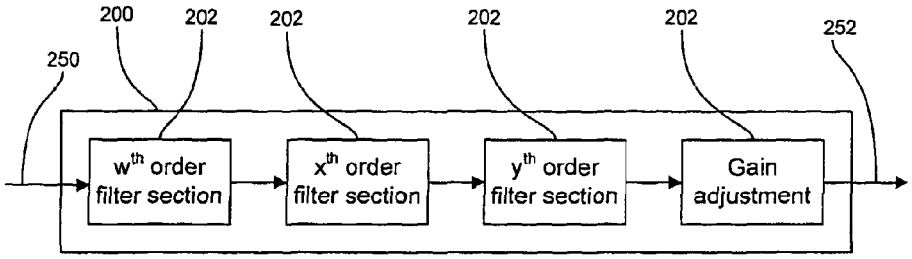
Figure 2C:
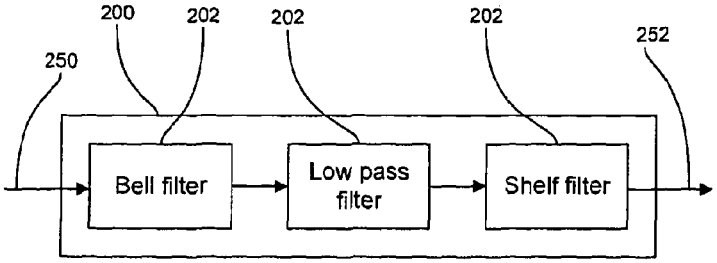

Embodiments of the invention are concerned with determining a configuration of an audio processing operation (or an audio processing function or procedure). FIGS. 2*a*, 2*b* and 2*c* schematically illustrate example audio processing operations 200. An audio processing operation 200 provides functionality or processing that receives input audio data 250, processes that input audio data 250 and outputs processed audio data 252. The input audio data 250 may take a variety of forms, such as: (i) a data stream (e.g. for realtime processing of audio), which could be based, for example, on audio input to the computer 102 via the microphone 125; or (ii) a data file stored on the storage medium 104 or in the memory 106. The output audio data 252 may subsequently be stored, for example on the storage medium 104 or in the memory 106 and/or may be played out via the speakers 121.

The audio processing operation 200 comprises one or more audio processing sub-operations 202, which may be viewed as discrete functional sub-units or processing blocks making up the audio processing operation 200 and which are arranged to perform their own respective audio processing functionality. In FIGS. 2*a*, 2*b* and 2*c*, the audio processing sub-operations 202 are shown in series (i.e. the output of one audio processing sub-operation 202 forms the input to another audio processing sub-operation 202 in the sequence of audio processing sub-operations). However, this need not necessarily be the case and the audio processing operation 200 may make use of more complex arrangements of audio processing sub-operations 202. In FIG. 2*a*, five audio processing sub-operations 202 are shown; in FIG. 2*b*, four audio processing sub-operations 202 are shown; and in FIG. 2*c*, three audio processing sub-operations 202 are shown. However, it will be appreciated that in embodiments of the invention, the audio processing operation may make use of any number N of audio processing sub-operations 202 where N≥1. Preferably, there is a plurality of audio processing sub-operations 202 as this improves the quality of audio processing achieved. An audio processing operation 200 may be implemented as hardware (e.g. an application specific integrated circuit (ASIC), a field programmable gate array (FPGA) or a digital signal processor (DSP) device), as software or as a combination of hardware and software, and an audio processing sub-operation 202 may therefore be an amount of hardware (e.g. an amount of resources of a digital signal processor chip) or software (e.g. a computer program function or subroutine).

In FIG. 2*a*, the first four audio processing sub-operations 202 are second order filter sections (or biquads) and the final audio processing sub-operation 202 is a gain controller. In general, a second order filter section is a digital filter whose transfer function, in the Z domain, is the ratio of two quadratic functions, namely:

$$H(z) = \frac{b_0 + b_1 z^{-1} + b_2 z^{-2}}{1 + a_1 z^{-1} + a_2 z^{-2}}$$

so that the output data sequence y(n) from that second order filter section depends on the data sequence x(n) input to that second order filter section as follows:

$$y(n)=b_0x(n)+b_1x(n-1)+b_2x(n-2)-a_1y(n-1)-a_2y(n-2)$$

There are many well-known ways of implementing a second order filter section in hardware and software and they shall therefore not be described in detail herein.

As can be seen from the above, in general a second order filter section has five coefficients: $a_1$, $a_2$, $b_0$, $b_1$, $b_2$. These coefficients may be set according to the frequency response of a desired filter.

Four-coefficient second order filter sections may be used instead as follows. The transfer function, in the Z domain, of a four-coefficient second order filter section may be:

$$H(z) = \frac{1 + b_1 z^{-1} + b_2 z^{-2}}{1 + a_1 z^{-1} + a_2 z^{-2}}$$

so that the output data sequence y(n) from that four-coefficient second order filter section depends on the data sequence x(n) input to the four-coefficient second order filter section as follows:

$$y(n)=x(n)+b_1x(n-1)+b_2x(n-2)-a_1y(n-1)-a_2y(n-2).$$

Effectively, coefficient $b_0$ has been set to 1, but it will be appreciated that it could be set to some other fixed value.

A sequence of K five-coefficient second order filter sections with their respective coefficients $a_1^k$, $a_2^k$, $b_0^k$, $b_1^k$, $b_2^k$ (for k=1 . . . K) may be implemented as (a) a sequence of K four-coefficient second order filter sections with respective coefficients $a_1^k$, $a_2^k$, $\hat{b}_1^k$, $\hat{b}_2^k$ (where $\hat{b}_1^k=b_1^k/b_0^k$ and $\hat{b}_2^k=b_2^k/b_0^k$ for k=1 . . . K) together with (b) a gain controller with a gain coefficient $g=b_0^1 b_0^2 \ldots b_0^K$ (i.e. an audio processing sub-operation 202 that simply scales an input sample x(n) to form an output sample y(n)=gx(n)). In this way, fewer coefficients need to be considered. In particular, implementing an audio processing operation 200 as a sequence of K five-coefficient second order filter sections makes use of 5K coefficients whilst implementing the same audio processing operation 200 as a sequence of K four-coefficient second order filter sections together with a gain controller makes use of 4K+1 coefficients.

Similarly, a sequence of K five-coefficient second order filter sections with their respective coefficients $a_1^k$, $a_2^k$, $b_0^k$, $b_1^k$, $b_2^k$ (for k=1 . . . K) may be implemented as (a) a sequence of K−1 four-coefficient second order filter sections with respective coefficients $a_1^k$, $a_2^k$, $\hat{b}_1^k$, $\hat{b}_2^k$ (where $\hat{b}_1^k=b_1^k/b_0^k$ and $\hat{b}_2^k=b_2^k/b_0^k$ for k=1 . . . K−1) together with (b) a five-coefficient second order filter section with coefficients $a_1^k$, $a_2^k$, $\hat{b}_0^k$, $\hat{b}_1^k$, $\hat{b}_2^k$ (where $\hat{b}_0^K=gb_0^K$, $\hat{b}_1^K=gb_1^K$ and $\hat{b}_2^K=gb_2^K$, where $g=b_0^1 b_0^2 \ldots b_0^{K-1}$). Again, this implementation of the audio processing operation 200 makes use of only 4K+1 coefficients.

It will be appreciated that other ways of implementing a sequence of K five-coefficient second order filter sections with one or more four-coefficient second order filter sections is possible.

The example audio processing operation 200 in FIG. 2*a* therefore preferably makes use of a sequence of four-coefficient second order filter sections together with a gain controller as its audio processing sub-operations 202. Whilst the gain controller audio processing sub-operation 202 has been shown as the final audio processing sub-operation 202 in FIG. 2*a*, it will be appreciated that this need not be the case and that the gain controller audio processing sub-operation 202 may be placed at any part of the chain of audio processing sub-operations 202 of FIG. 2*a*. The use of four-coefficient second order filterer sections in this way instead of five-coefficient second order filter sections means that fewer coefficients need to be calculated and set, which makes configuring the audio processing operation 200 quicker and easier.

Embodiments of the invention are not limited to the use of second order filter sections. Therefore, in FIG. 2*b*, the first three audio processing sub-operations 202 are filter sections of order w, x and y respectively, where w, x and y are any positive integers and may or may not be the same as each other. Each filter section will have its own respective set of coefficients. The final audio processing sub-operation 202 is (as in FIG. 2*a*) a gain controller, but it will be appreciated that the use of a gain controller is optional (in a similar manner to what has been described above for FIG. 2*a*).

The audio processing sub-operations 202 may be any form of audio processing functionality and need not be implemented as an r-th order filter section for some positive integer r. The audio processing sub-operations 202 shown in FIG. 2*c* are shown generally as example audio processing units of a bell filter, a low pass filter and a shelf filter. Whilst some of these may be implemented as respective r-th order filter sections, this need not be the case. It will be appreciated that other types of audio processing functionality (e.g. high pass filter, band-pass filter, etc.) may be provided by an audio processing sub-operation 202.

In general, then, an audio processing operation 200 comprises a set of one or more audio processing sub-operations 202. Each audio processing sub-operation 202 is configurable with one or more respective configuration parameters (or variables)—a configuration parameter of an audio processing sub-operation 202 determines (at least in part) the particular audio processing functionality provided by that audio processing sub-operation 202. For example: a five-coefficient second order filter section has five configuration parameters, namely the five coefficients $a_1$, $a_2$, $b_0$, $b_1$, $b_2$; a four-coefficient second order filter section has four configuration parameters, namely the four coefficients $a_1$, $a_2$, $b_1$, $b_2$; a gain controller has a single configuration parameter, namely the gain value g; a general r-th order filter section will have a corresponding number of coefficients (in a similar manner to the second order filter section) and these form the configuration parameters for that r-th order filter section; and when not implemented as a r-th order filter section, filters such as a bell-filter, a low-pass, band-pass, high-pass filter and shelf filter have at least one or more of frequency, gain and Q as their configuration parameters.

Embodiments of the invention are particularly concerned with an audio processing operation 200 that comprises a predetermined set of one or more audio processing sub-operations 202. For example, a manufacturer of a consumer electronics device (such as a mobile telephone, a television, an MP3 player or a home cinema system) may provide only a predetermined limited number of biquads for the audio processing to generate output audio from the device, particularly when the amount of hardware/silicon used in, and the power consumption of, the device are to be kept to a minimum. As another example, a software application may only have limited processing time available for performing audio processing and hence the audio processing software may comprise a predetermined sequence of audio processing functions. In other words, there may be limitations or constraints on the hardware or software or time available for performing an audio processing operation and hence an audio processing operation 200 may be restricted to a predetermined set of one or more audio processing sub-operations 202. This is not to say that the configuration parameters of the audio processing sub-operations 202 themselves are predetermined, only that the type and number (and possibly the order/structure) of the audio processing sub-operations 202 is predetermined (e.g. specific configurable hardware resources are available for use in the audio processing operation 200 and/or specific configurable software functions are available for use in the audio processing operation 200).

Embodiments of the invention are then concerned with determining a configuration for the audio processing operation 200 (and then possibly configuring a target device accordingly), the configuration comprising a respective value for each configuration parameter of the/each audio processing sub-operation 202 of the predetermined set of audio processing sub-operations 202. For example, it may be desirable to "tune" the device (mobile telephone, television, MP3 player, home cinema system, etc.) or the software application that makes use of (or implements or realises) the audio processing operation 200 so as to achieve a certain sound effect—the tuning then involves determining specific values for the configuration parameters of the/each audio processing sub-operation 202.

Figure 3:
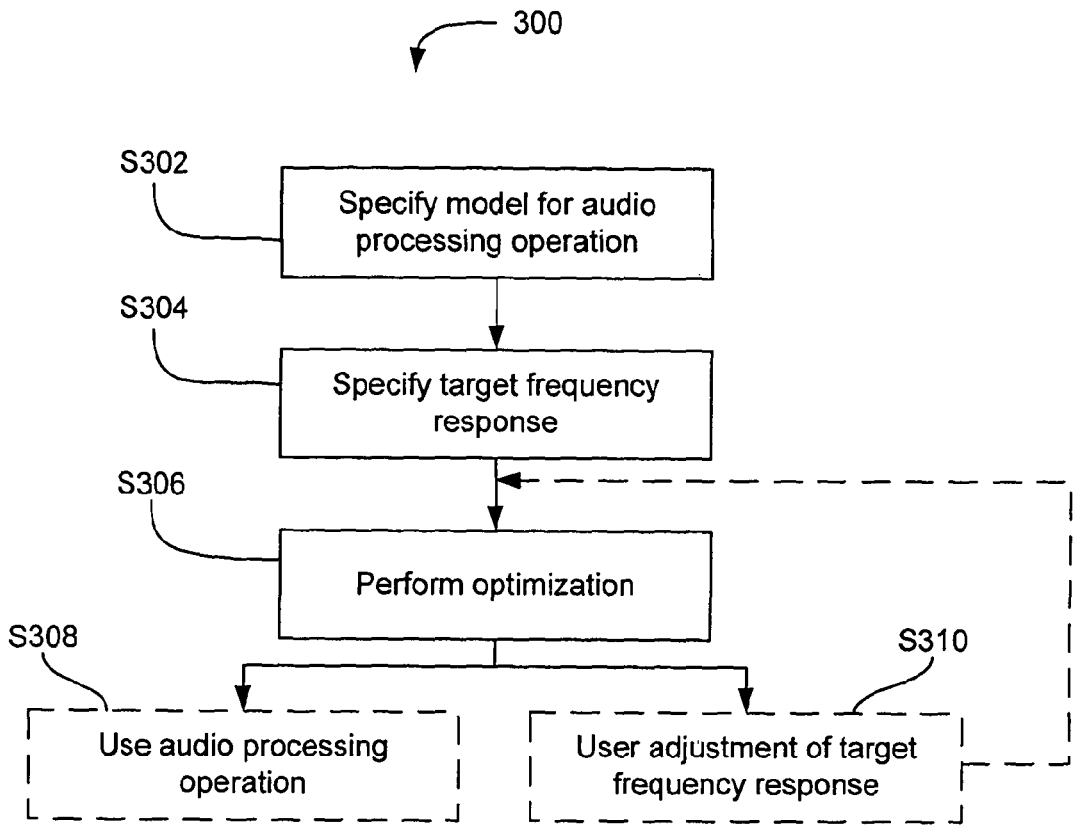
FIG. 3 is a flowchart schematically illustrating a computer-implemented method of determining a configuration for an audio processing operation according to an embodiment of the invention.

FIG. 3 is a flowchart schematically illustrating a computer-implemented method 300 of determining a configuration of an audio processing operation 200 according to an embodiment of the invention. This method may be embodied in a computer program (or configuration determination software application) to be executed by the processor 108 of the computer 102. However, it will be appreciated that the computer 102 is not necessarily the target device that is ultimately to carry out the audio processing operation 200—for example, a laptop or personal computer 102 may be used to execute this application to calculate the configuration for an audio processing operation 200 of a target mobile telephone, with the mobile telephone then being configured subsequently according to the calculated configuration. The software application being executed by the processor 108 may present the operator of the computer 102 with a user interface (displayed on the monitor 120) via which selections or input may be provided from the user to the application and via which information may be displayed to the user. The user interface may make use of any well-known input/output components (e.g. drop-down menus, drag-and-drop movement of items, etc.).

At a step S302, a model or budget for the audio processing operation 200 is specified, i.e. the make-up of the predetermined set of one or more audio processing sub-operations 202 for the audio processing operation 200 is specified. For the example audio processing operation 200 of FIG. 2*a*, this may involve specifying that a sequence of four four-coefficient biquads and a gain controller is to be used; for the example audio processing operation 200 of FIG. 2*b*, this may involve specifying that a sequence of a w-th order filter section, an x-th order filter section, a y-th order filter section and a gain controller is to be used; and for the example audio processing operation 200 of FIG. 2*c*, this may involve specifying that a sequence of a particular implementation of a bell filter, a particular implementation of a low pass filter and a particular implementation of a shelf filter is to be used. In other words, the hardware resources (e.g. processing resources of a digital signal processing chip) and/or the software functions available for carrying out (or implementing) the audio processing operation 200 is specified. At the step S302, the configuration parameters available for configuring the one or more audio processing sub-operations are specified or identified (although their actual values are not determined/specified yet). Essentially, the information provided at the step S302 enables the configuration determination application to simulate or model the audio processing operation 200 (with its predetermined set of audio processing sub-operations 202) and then configure and test the simulated audio processing operation 200, i.e. so that specific configurations for the audio processing operation 200 may be tested and adjusted accordingly to match the requirements of an operator of the configuration determination application. The operator may provide this model information to the configuration determination application via the user interface in a variety of ways (e.g. by selecting audio processing sub-operations 202 from a drop-down list of known audio processing sub-operations 202, selecting their number and their order, etc.).

At a step S304, a target frequency response for the audio processing operation 200 is specified. Methods of doing this shall be described later with reference to FIG. 4.

At a step S306, a convergent optimization process is performed to determine a configuration for the audio processing operation 200. The configuration is "optimized" in that the use of this configuration (i.e. the setting of the configuration parameters of the audio processing sub-operations 202 to the values specified by the configuration) reduces (and ideally minimizes) a difference between the frequency response of the audio processing operation 200 and the target frequency response. Methods of doing this shall be described later with reference to FIGS. 5*a* and 5*b*.

The step S306 may include displaying (on the display 120) a representation of the target frequency response together with a representation of the frequency response of the audio processing operation 200 if the audio processing operation 200 were to be configured with the determined configuration (i.e. if the configuration parameters for the/each audio processing sub-operation 202 were set to the respective values of the determined configuration). In this way, the operator can gauge how well the optimization process has matched the frequency response of the configured audio processing operation 200 to the target frequency response. A metric indicating the size of the difference between these two frequency responses may also be displayed (e.g. a root-mean-squared error between the two frequency responses). The operator can thus check whether he is satisfied with the determined configuration.

After the step S306, the configuration has been determined and the processing 300 may stop there.

However, in some embodiments of the invention, the method 300 includes a step S308 at which the audio processing operation 200 is implemented/simulated by the configuration determination application (or some other application) and then configured with the configuration determined at the step S306 (i.e. the configuration parameters for the/each audio processing sub-operation 202 are set to the respective values of the determined configuration). The configured audio processing operation 200 is then used to process input audio data 250 so as to output processed audio data 252. In this way, a user may listen to the sound effects produced by configuring the audio processing operation 200 and can check whether he is satisfied with the determined configuration.

Additionally and/or alternatively, the method 300 may include a step S310 at which a user may adjust the target frequency response. For example, the user may consider the determined configuration to be not to his liking (e.g. by listening to the processed audio data 252 output at the step S308 or by comparing a display of the target frequency response with a display of the actually achieved frequency response of the audio processing operation 200) and may therefore modify the target frequency response accordingly or may specify a new target frequency response.

Thus, a software application according to an embodiment of the invention that implements the method 300 may: implement the steps S302, S304 and S310 as one thread/process with which the user may interact via the user interface to specify and/or modify the model for the audio processing operation 200 and/or the target frequency response; implement the step S306 as another thread/process that performs the optimization upon receipt/detection of a new (or updated) model for the audio processing operation 200 and/or a new (or updated) target frequency response; and implement the step S308 as another thread/process that makes use of the configuration to perform audio processing.

Figure 4:
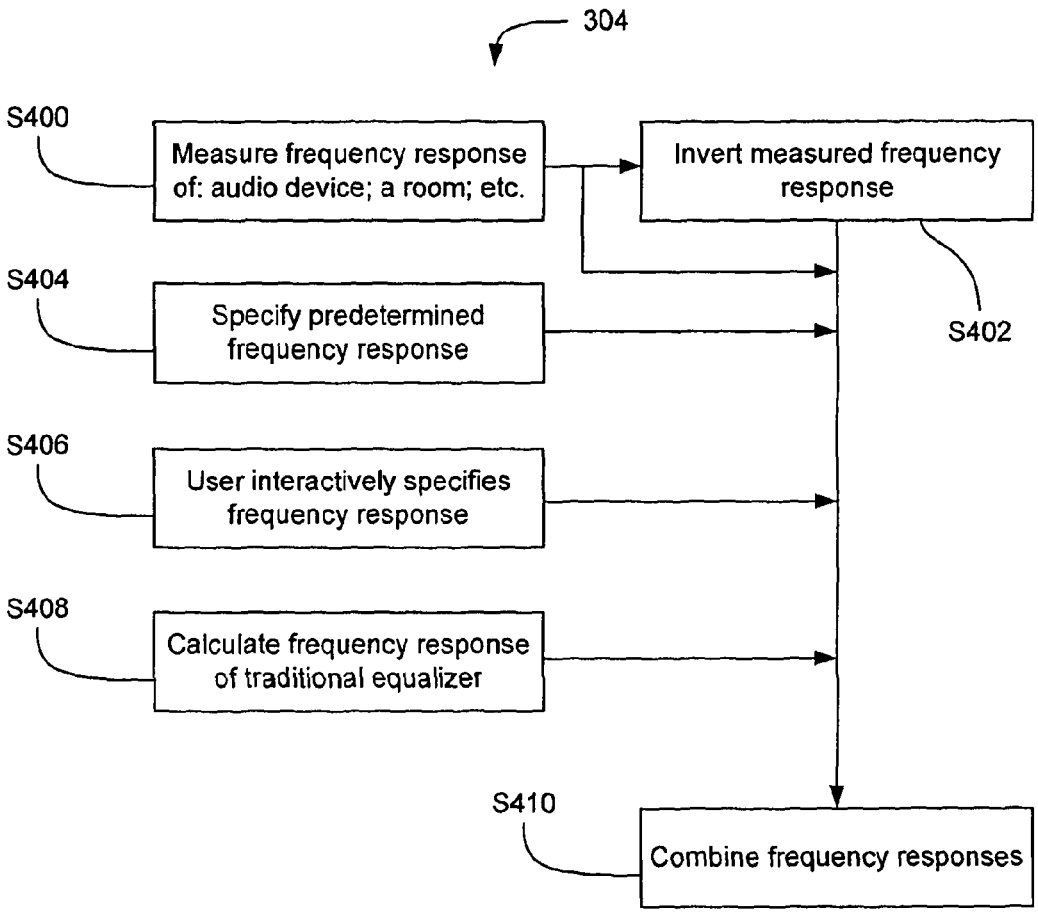
FIG. 4 is a flowchart schematically illustrating the processing to specify a target frequency response for the audio processing operation according to an embodiment of the invention.

FIG. 4 is a flowchart schematically illustrating the processing performed in one embodiment of the invention at the step S304 of the method 300 of FIG. 3, i.e. the processing to specify a target frequency response for the audio processing operation 200.

At a step S400, a frequency response may be measured (e.g. a frequency response of a room, of an audio output device, etc.). As an example, the frequency response of a speaker 121 may be measured by providing a pink noise signal to the speaker 121 for the speaker 121 to output—the actual audio output by the speaker 121 may then be received at the microphone 125 and a corresponding input audio signal may then be provided to the processor 108. The processor 108 may then determine the frequency response of the speaker 121 from the audio signal received from the microphone 125. Determination of the frequency response is well-known and shall not be described herein. Processing may then continue at a step S402 at which the frequency response measured at the step S400 is inverted to form a target frequency response that compensates for the characteristics of the measured room/device/etc.

Additionally, or alternatively, the step S304 may include a step S404 at which a predetermined frequency response is specified as a target frequency response. For example, a frequency response dictated by a specific target application, by a standards body or by listening tests may be specified.

Additionally, or alternatively, the step S304 may include a step S406 at which a user may interactively specify a target frequency response. For example, the user may be provided with an interface showing a plot of gain (or amplitude) vs log-frequency on which the user may define a log-frequency vs gain curve. In other words, at the step S406, the user may be allowed to modify a curve representing a frequency response to define a desired frequency response. Methods of defining such a target frequency response are well known and shall not be described herein.

Additionally, or alternatively, the step S304 may include a step S408 at which a traditional graphic equalizer or a traditional parametric equalizer may be synthesised/simulated (allowing the user to adjust the various controls of that graphic equalizer or of that parametric equalizer) and the frequency response of that traditional graphic equalizer or of that traditional parametric equalizer may be calculated to provide a target frequency response. Traditional graphic equalizers and traditional parametric equalizers and their various respective controls are well-known and shall therefore not be described in detail herein. However, it will be appreciated that other kinds of audio equalizers may be used (such as bell, shelf, filter, etc.) and that the step S408 may involve using the frequency response of any audio equalizer or of a combination of audio equalizers as a target frequency response.

In some embodiments of the invention, a single target frequency response is provided by just one of the steps S400, S402, S404, S406 and S408. However, in some embodiments of the invention, one or more of the steps S400, S402, S404, S406 and S408 may be used individually or collectively to specify a plurality of initial frequency responses. A step S410 may then be used at which the initial frequency responses are combined to form the actual target frequency response that is to be used. Performing this combination may comprise one or more of: weighting one or more of the initial target frequency responses (i.e. multiplying it by a respective weight); adding at least two (possibly weighted) initial frequency responses; subtracting one (possibly weighted) initial frequency response from another (possibly weighted) initial frequency response; and using the frequency response defined by one (possibly weighted) initial frequency response over a first range of frequencies and using the frequency response defined by another (possibly weighted) initial frequency response over a second range of frequencies—such operations may, of course, be cascaded to form a series of combinations based on initial frequency responses and intermediate combination results. It will, however, be appreciated that other forms of combination may be used.

The use of the step S410 to combine a plurality of initial frequency responses so as to generate a single target frequency response helps save the number of audio processing sub-operations 202 that would be required to achieve a desired effect. Traditionally, one would configure a first audio processing operation based on a first initial frequency response, then configure a second audio processing operation (which processes the output from the first audio processing operation) based on a second initial frequency response, then configure a third audio processing operation (which processes the output from the second audio processing operation) based on a third initial frequency response, etc. Such an approach requires a significantly larger amount of processing resources than required by the approach taken when using the step S410 of FIG. 4. Thus, the predetermined set of audio processing sub-operations 202 may be smaller than previously required whilst still providing the same audio processing functionality as previously provided. Viewed another way, for a given predetermined set of audio processing sub-operations 202, the use of the step S410 of FIG. 4 enables more audio processing functionality to be achieved (e.g. a layering of multiple sound effects/equalization/etc. can be implemented, such as frequency response equalization, bass enhancement, dynamic range control, aesthetic effects such as stereo widening).

It will be appreciated that embodiments of the invention may use any other suitable means by which a user may indicate (either directly or indirectly) a target frequency response. Additionally, it will be appreciated that the configuration determination application may present the user with a user interface having any suitable controls for determining or setting the target frequency response, such as controls to enable the user to: define and/or modify a log-frequency vs gain plot to specify a frequency response; specify a predetermined frequency response from a list of predetermined frequency responses; open a file storing data specifying a frequency response; make a selection of how multiple frequency response are to be combined; etc.

Additionally, it will be appreciated that the target frequency response specified at the step S304 may be completely independent of the predetermined set of one or more audio processing sub-operations 202. For example, the target frequency response may be much more complex (i.e. of a higher order) than the frequency response achievable with the predetermined set of one or more audio processing sub-operations 202 (no matter what values are assigned to the configuration parameters of the one or more audio processing sub-operations 202). The aim, though, is for the optimization process at the step S306 to try to make the frequency response of the audio processing operation 200 approximate as well as possible the target frequency response by determining values for the control parameters of the/each audio processing sub-operation 202.

Figure 5A:
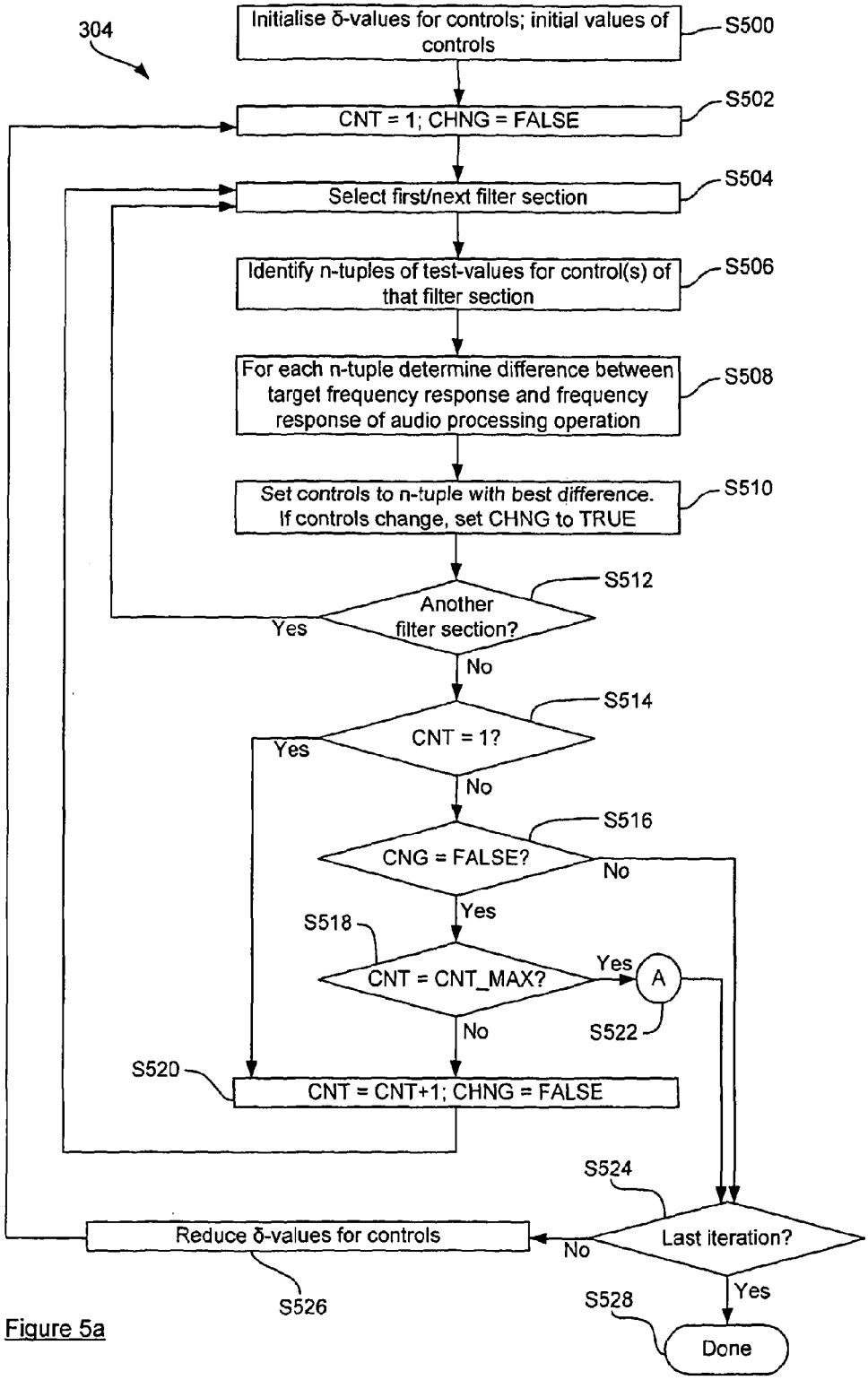
FIGS. 5*a* and 5*b* together form a flowchart schematically illustrating the processing performed in one embodiment of the invention to optimize configuration parameters for one or more audio processing sub-operations of an audio processing operation.
Figure 5B:
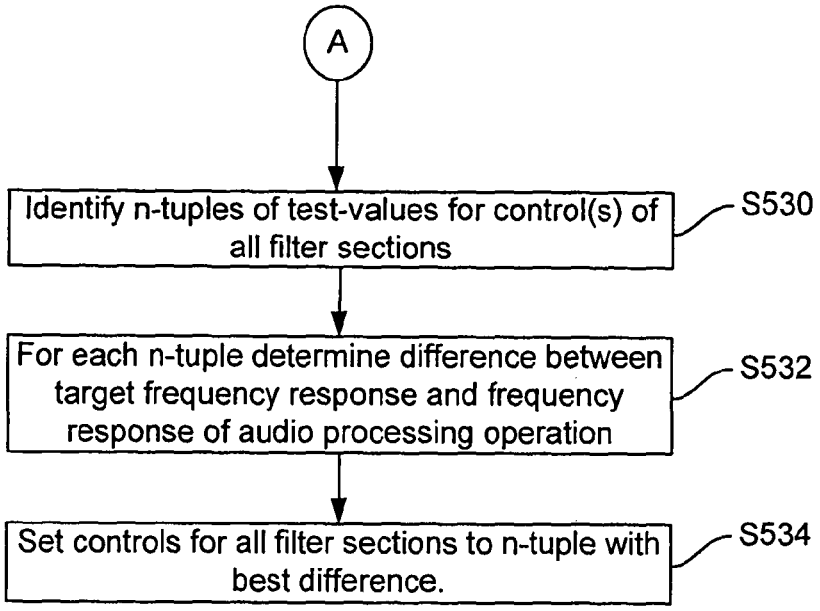

FIGS. 5*a* and 5*b* together form a flowchart schematically illustrating the processing performed in one embodiment of the invention at the step S306 of the method 300 of FIG. 3, i.e. the processing to optimize the configuration parameters for the one or more audio processing sub-operations 202 of the audio processing operation 200.

For many audio processing sub-operations 202, a corresponding configuration parameter exhibits one or more of the following properties: (a) it is not "monotonic" (i.e. the frequency response of the audio processing sub-operation 202 does not change monotonically as the configuration parameter is increased or decreased); (b) it is not "local" (i.e. the frequency response of the audio processing sub-operation 202 undergoes substantial changes over a broad range of frequencies as the configuration parameter is changed, or, put another way, the change to the frequency response of the audio processing sub-operation 202 induced by changing the configuration parameter is not restricted to a limited range of frequencies); and (c) it is not "proportional" (i.e. the change of the frequency response of the audio processing sub-operation 202 is not proportional to the change of the configuration parameter). As such, performing optimization directly on the configuration parameters themselves is difficult and time consuming and, in some circumstances, such an optimization process would not converge to a suitable set of values for the configuration parameters (an optimization process converges, or is convergent, if it is guaranteed to terminate having determined a stable set of values for the variables it is optimizing).

For example, the configuration parameters $a_1$, $a_2$, ($b_0$), $b_1$ and $b_2$ for a second order filter section are highly non-monotonic, non-local and non-proportional, making achievement of a desired frequency response by directly adjusting these configuration parameters very difficult.

Consequently, preferred embodiments of the invention perform the optimization process at the step S306 by varying or adjusting respective "control values" or "control settings" that are related to the/each audio processing sub-operation 202 and from which the respective configuration parameters for the/each audio processing sub-operation 202 may be calculated or determined. The optimization process therefore determines a set of values for the control settings that reduces (or attempts to minimize) a difference between the target frequency response and the frequency response of the audio processing operation 200 when the configuration parameters of the/each audio processing sub-operation 202 are set based on the determined values for the control settings. Once the values for the control settings have been determined, they may be mapped to respective values for the control parameters—these values for the control parameters then form the configuration to be the output of the step S306.

As such, a control setting should preferably be one or more of: (a) monotonic (so that the frequency response of the audio processing sub-operation 202 changes monotonically as the value of the control setting is increased or decreased); (b) local (so that the frequency response of the audio processing sub-operation 202 only undergoes substantial changes over a limited range of frequencies as the value of the control setting is changed, i.e. only substantially localized changes in the frequency response are induced by changes to the value of the control setting); and (c) proportional (so that the magnitude of the change of the frequency response of the audio processing sub-operation 202 is substantially proportional to the magnitude of the change in value of the control setting). The use of such control settings, and the optimization based on varying such control settings, ensures that the optimization process will converge to a suitable set of values of the control settings (from which a suitable set of configuration parameters may then be determined).

Suitable example control settings therefore include ones that correspond to a property adjustable by operation of a traditional graphic equalizer (for example, the gain at one or more particular frequencies) or ones that correspond to a property adjustable by operation of a traditional parametric equalizer (for example: gain, frequency and Q). Such control settings were implemented on the traditional graphic or parametric equalizers due to their monotonic, local and proportional properties which makes them understandable by human operators. These properties are exploited by the optimization performed at the step S306 by some embodiments of the invention. However, it will be appreciated that other monotonic, local and proportional control settings may be used additionally or alternatively in other embodiments of the invention (such as a property adjustable by user operation of any traditional audio equalizer).

Embodiments of the invention preferably make use of a series of one or more four-coefficient biquads together with a gain controller as the predetermined set of audio processing sub-operations 202 (as illustrated in FIG. 2*a*). A convergent optimization process shall therefore be described below with reference to such a predetermined set of audio processing sub-operations 202. However, it will be appreciated that similar optimization processes may be used with different audio processing sub-operations 202 and that the method described below applies analogously to those other audio processing sub-operations 202, their configuration parameters and associated control settings.

Figure 6:
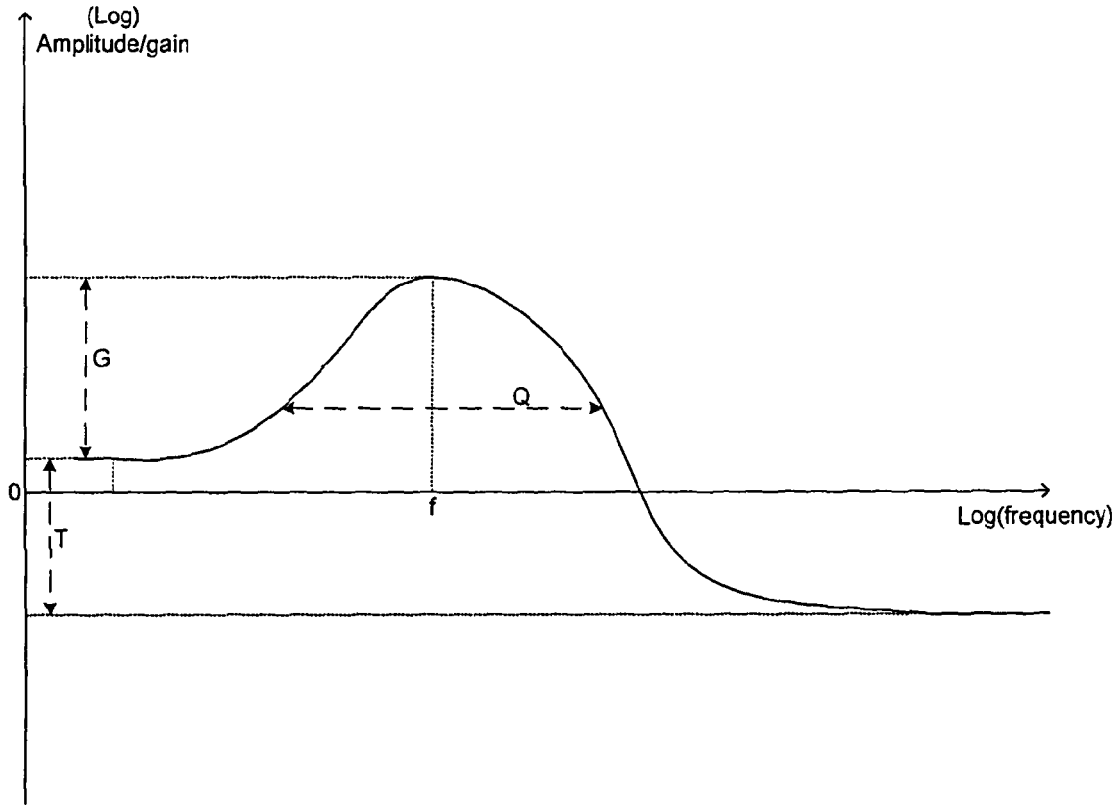
FIG. 6 schematically illustrates an example frequency response for a second order filter section.

For each four-coefficient bi-quad, the following four control settings are used are: gain (G); frequency (f); Q; and tilt (T). Gain, frequency and Q are the controls used for a traditional bell or presence filter (as are well-known in this field of technology). Tilt represents the difference in amplitude/gain between the flat portions the frequency response either side of the frequency of the bell. This is illustrated schematically in FIG. 6. Gain (G), frequency (f) and Q are control settings which are normally user-controllable on a traditional parametric equalizer. A traditional parametric equalizer does not allow a user to adjust the tilt (T) of a bell filter as this is usually difficult for a user to control reliably or intuitively. These four control settings adjust the overall shape of the frequency response of the second order filter section (as can be seen in FIG. 6). However, the overall gain (i.e. the relative "height" of the whole frequency response curve up/down the amplitude axis in FIG. 6) is not determined by these four control settings—this is the purpose of the final gain controller audio processing sub-operation 202.

The control settings G, f, Q and T are monotonic, local and proportional. They are related to the coefficients of a five-coefficient second order filter section (i.e. $a_1$, $a_2$, $b_0$, $b_1$, $b_2$) as the discussed below. The determination of the coefficients of a four-coefficient second order filter section (i.e. $a_1$, $a_2$, $b_1$, $b_2$) together with the gain of an overall gain controller so as to achieve the same frequency response as a five-coefficient second order filter section has been described above.

The following inputs are used:

Q—the ordinary bell Q gain db—the ordinary bell gain in dB—this is the same as gain (G) above shelf_db—the gain in dB of an ordinary shelf (namely the difference between gain at DC and gain at half the audio sampling frequency)—this is the same as tilt (T) above frequency—the ordinary bell frequency—this is the same as frequency (f) above sampling_rate—the digital audio sampling frequency The following outputs are determined:

$b_0$, $b_1$, $b_2$—i.e. the three feed forward coefficients of the second order filter section $a_1$, $a_2$—i.e. the two feedback coefficients of the second order filter section The following intermediate variables/values are used:

gainlin—a linear gain of an ordinary bell shelflin—a linear gain of an ordinary shelf af—a bell angular frequency tz—tan half angular frequency of zeros tp—tan half angular frequency of poles gz—gain of zeros gp—gain of poles Then, to calculate the coefficients of a five-coefficient second order filter section (i.e. $a_1$, $a_2$, $b_0$, $b_1$, $b_2$) based on the control settings of G, f, Q and T, the following calculation may be performed:

Set $gainlin = 10^{(gain_db/20)}$ to convert the dB gain gain_db to a linear gain $gainlin$ Set $shelflin = 10^{(shelf_db/20)}$ to convert the dB gain shelf_db to a linear gain $shelfin$ Set $af = \frac{2\pi * \text{frequency}}{\text{sampling_rate}}$ Set $tz = \tan(af/2) * shelflin$ -continued Set $tp = \frac{\tan(af/2)}{shelfin}$ Then, if gain_db ≥ 0, set $gz = \frac{af * gainlin}{2Q * \sin(af)}$ and $gp = \frac{af}{2Q * \sin(af)}$; otherwise if gain_db < 0, set $gz = \frac{af}{2Q * \sin(af)}$ and $gp = \frac{af}{2Q * \sin(af) * gainlin}$.

Then:

$$b_0 = \frac{shelflin^2 * tp^2 * (1 + 2 * gz * tz * tz^2)}{tz^2 * (1 + 2 * gp * tp + tp^2)}$$

$$b_1 = \frac{2b_0 * (tz^2 - 1)}{(1 + 2 * gz * tz + tz^2)}$$

$$b_2 = \frac{b_0 * (tz^2 - 2 * gz * tz + 1)}{(1 + 2 * gz * tz + tz^2)}$$

$$a_1 = \frac{2(tp^2 - 1)}{(1 + 2 * gp * tp + tp^2)}$$

$$a_2 = \frac{(tp^2 - 2 * gp * tp + 1)}{(1 + 2 * gp * tp + tp^2)}$$

Therefore, if suitable values for the control settings G, f, Q and T can be determined for a four-coefficient second order filter section as an audio processing sub-operation 202, then the four configuration parameters for that audio processing sub-operation 202 (i.e. the four coefficients $a_1$, $a_2$, $b_1$, $b_2$) may be set accordingly by mapping (or transforming or converting) G, f, Q and T to $a_1$, $a_2$, $b_1$, $b_2$ via the above equations. It will be appreciated that the above is merely an example of how to determine $a_1$, $a_2$, $b_1$, $b_2$ and that the explicit calculation of one or more intermediate values need not be carried out.

In some embodiments, the control setting of tilt (T) is not used (i.e. the value of T may be set to a predetermined value, usually 0). The set of control settings used by the optimization process (i.e. G, f and Q) would then be the same as the controls that a user may adjust on a traditional parametric equalizer. However, the use of the control setting of tilt (T) enables much greater flexibility in determining and calculating the configuration parameters for the audio processing sub-operations 202 and can help vastly reduce the actual number of audio processing sub-operations 202 that are required to a particular audio effect (i.e. better/more audio effects are achievable for a fixed number of audio processing sub-operations 202; or a smaller number of audio processing sub-operations 202 are required for a given quality of audio effect). In the example, described below, the value of tilt (T) is used as a control setting.

The optimization process performed at the step S304 involves performing a predetermined number of iterations. This helps ensure that the optimization process will converge to a final result. Each iteration involves testing different values for the various control settings. Therefore, for each iteration and for each of the control settings G, f, Q and T there is a corresponding δ-value (namely $\delta_G$, $\delta_f$, $\delta_Q$, $\delta_T$) which represents how much the value for that control setting may be changed at the current iteration. If there are multiple second order filter section audio processing sub-operations 202, then the control settings for each second order filter section audio processing sub-operation 202 may have their own respective δ-value (i.e. one second order filter section audio processing sub-operation 202 may have its own δ-values for its G, f, Q and T control settings whilst another second order filter section audio processing sub-operation 202 may have its own potentially different δ-values for its G, f, Q and T control settings). Alternatively, there may be a respective single δ-value for each type of control setting (i.e. a single $\delta_G$, $\delta_f$, $\delta_Q$, $\delta_T$) and that single δ-value may apply across each second order filter section audio processing sub-operation 202. At an iteration, the values to be tested for the control setting G of a second order filter section are G, $G+\delta_G$ and $G-\delta_G$. It will be appreciated, however, that other values may be tested for the control setting G, such as G, $G+0.5\delta_G$, $G+\delta_G$, $G-0.5\delta_G$ and $G-\delta_G$. Analogous values are tested for the other control settings.

Turning, then, to FIG. 5*a*, the processing at the step S304 begins at a step S500 at which values for the control settings for the/each audio processing sub-operation 202 are initialised. The control settings may be initialised to any values. The initial values for the control settings for one second order filter section may be the same as or may be different from the initial values for the control settings for another second order filter section. Additionally, at the step S500, the δ-values for the control settings of are initialised. Again, the initialisation values for the δ-values may be any suitable values—the larger the initial values the large the possible changes that can be made to the control settings and potentially a better fit to the target frequency response can be achieved.

At a step S502, a counter CNT is initialised to the value 1 and a Boolean variable/flag CHNG is initialised to the value FALSE. The use of CNT and CHNG shall be described in more detail below.

At a step S504, a first one of the second order filter section audio processing sub-operations 202 is selected.

At a step S506, n-tuples (i.e. a set of n values) of test-values for the control settings of the selected second order filter section audio processing sub-operation 202 are identified. An n-tuple of test-values for the control settings comprises, for each control setting, a corresponding test-value (so that n equals the number of control settings for that audio processing sub-operation 202). For example, an n-tuple of test-values may be of the form of a 4-tuple (or vector with four elements) comprising a test value $t_G$ for G, a test value $t_f$ for f, a test value $t_Q$ for Q and a test value $t_T$ for T, i.e. the n-tuple is the vector ($t_G$, $t_f$, $t_Q$, $t_T$).

Given the different values of each control setting to be tested (as mentioned above), there will be $3^{number_of_control_settings}=81$ 4-tuples for the selected second order filter section audio processing sub-operation 202. These may be determined as follows: the m-th 4-tuple (m=1 . . . 81) is the vector ($t_G$, $t_f$, $t_Q$, $t_T$), where $$t_G = G + (1 - (m \bmod 3))\delta_G,$$

$$t_f = f + \left(1 - \left(\left\lceil \frac{m}{3} \right\rceil \bmod 3\right)\right)\delta_f$$

$$t_Q = Q + \left(1 - \left(\left\lceil \frac{m}{9} \right\rceil \bmod 3\right)\right)\delta_Q$$

$$t_T = T + \left(1 - \left(\left\lceil \frac{m}{27} \right\rceil \bmod 3\right)\right)\delta_T$$

and where G, f, Q and T are the current values for the control settings for the selected second order filter section audio processing sub-operation 202. In this way, all possible values of a control setting without modification by its δ-value or with an increment or a decrement by its δ-value are tried in combination with the analogous possible values for the other control settings.

At a step S508, each of the identified n-tuples of values for the control settings is tested. In particular, for each n-tuple:

(a) Corresponding values for the configuration parameters for the selected second order filter section audio processing sub-operation 202 are determined by mapping the respective control settings of the n-tuple to configuration parameters.

(b) For each other audio processing sub-operation 202, its current control setting values are used in an analogous manner to determine configuration parameters for that audio processing sub-operation 202.

(c) The frequency response of (or achieved by) the resulting audio processing operation 200 is calculated (by methods well known in this field of technology), i.e. when the audio processing sub-operations 202 are configured with their respective configuration parameters.

(d) A difference between the calculated frequency response and the target frequency response is calculated. This difference may be determined in many ways but preferred embodiments calculate the root-mean-squared (RMS) error between the target frequency response and the calculated frequency response in the log-frequency vs amplitude/gain domain, or, even more preferably, in the log-frequency vs log-amplitude/gain domain as shown in FIG. 6 (since using decibels for gain instead of using linear gain usually provides for better comparisons). In some embodiments of the invention, the user interface that the configuration determination application provides to the operator may allow the operator to set a particular range of frequencies over which the difference is to be calculated (e.g. to gate off, or ignore, the difference in frequency response at certain frequencies that may be of no interest to the operator).

When calculating the difference based on the RMS error between the target frequency response and the calculated frequency response, advantage may be taken of the fact that an RMS difference between two sets of data (in this case, the target frequency response and the calculated/achieved frequency response) is a minimum when the individual means of the two sets of data are equal. Thus, the step S508 may also involve, for each n-tuple:

calculating the mean ($\mu_T$) of the target frequency response (it will be appreciated that this needs only be performed once for the entire optimization as the mean ($\mu_T$) does not change during the optimization process—the calculated mean ($\mu_T$) can then be reused when necessary);

calculating the mean ($\mu_A$) of the frequency response achieved when (i) each biquad in the series of one or more four-coefficient biquads is configured with its respective configuration parameters (as determined at steps (a) and (b) above) and (ii) the gain g for the gain controller is set to unity;

setting the gain g for the gain controller to be ($\mu_T-\mu_A$)—doing this ensures that the mean of the frequency response achieved from the audio processing operation 200 will be equal to the mean of the target frequency response; and then calculating the RMS difference.

In this way, the configuration parameter (i.e. gain) for the gain controller audio processing sub-operation 202 is determined.

At a step S510, the n-tuple which led to the smallest calculated difference/error is chosen and the control settings for the selected second order filter section audio processing sub-operation 202 are set to the corresponding values from this n-tuple. If this involves a change in a value for one or more of the control settings for the selected second order filter section audio processing sub-operation 202 then the Boolean flag CHNG is set to the value TRUE. Hence, the Boolean flag indicates whether a change in control settings for one of the audio processing sub-operations 202 has been implemented.

At a step S512, a determination is made as to whether there is another second order filter section audio processing sub-operation 202 to select; if so, processing returns to the step S504 at which the next second order filter section audio processing sub-operation 202 is selected so that its control settings may be tested and possibly adjusted; otherwise, processing continues at a step S514.

At the step S514, a determination is made as to whether the counter CNT has the value 1. The counter CNT will have a value 1 if this is the first time that the control settings have been adjusted/determined for the present iteration of the optimization process. If CNT has a value 1, then processing continues at a step S520; otherwise processing continues at a step S516.

At the step S520, the value of the counter CNT is incremented and the Boolean flag CHNG is reset to be FALSE.

At the step S516, a determination is made as to whether the Boolean flag CHNG is FALSE. The Boolean flag CHNG will only be FALSE if the most recent execution of the steps S504-S512 for the whole set of second order filter section audio processing sub-operations 202 has not resulted in a change of any control settings. Thus, if no change has occurred then there is no need to re-try the steps S504-S512 for the whole set of second order filter section audio processing sub-operations 202 to determine new control setting values for the present iteration—hence, processing continues at a step S524. Otherwise, if a change has occurred to at least one of the control settings then processing continues at a step S518.

At the step S518, a determination is made as to whether the counter CNT has the value CNT_MAX, which is a predetermined threshold value. If the counter CNT has the value CNT_MAX, then it is assumed that the repeated performance of the steps S504-S512 for the whole set of second order filter section audio processing sub-operations 202 is not yielding stable values for the control settings (e.g. two or more control settings could simply be swapping values for each performance of the steps S504-S512 for the whole set of second order filter section audio processing sub-operations 202). Hence, processing continues at a step S522 at which an alternative control setting testing strategy is implemented (as will be described with reference to FIG. 5*b*) before continuing at the step S524. Alternatively, if the counter CNT does not have the value CNT_MAX then processing continues at the step S520. The use of the threshold value CNT_MAX helps ensure that the optimization process will converge.

At the step S524, a determination is made as to whether the current iteration is the last iteration. For example, a predetermined number of iterations may be performed in order to ensure that the optimization process will converge. If the present iteration is not the last iteration, then processing continues at a step S526 at which the δ-values are reduced—this may, preferably, be achieved by halving each δ-value. Processing would then return to the step S502 at which a new iteration is commenced. Alternatively, if the present iteration is the last iteration, then processing terminates at a step S528. At the step S528, the respective configuration parameters for the/each second order filter section are determined as a function of the respective values for their control settings. Similarly, the gain (g) for the gain controller audio processing sub-operation 202 may be set using the method described above with reference to the step S508. The configuration for the audio processing operation 200 is then output from the step S306, the configuration comprising the determined configuration parameters for the/each audio processing sub-operation 202.

Turning, then, to FIG. 5*b*, the processing of the step S522 is shown in more detail. In particular, the step S522 is reached when trying to optimize the control setting values for each audio processing sub-operation 202 individually has not resulted in stable values after a predetermined (CNT_MAX) number of attempts. Hence, at the step S522, the optimization process attempts to determine values for each audio processing sub-operation 202 collectively (i.e. by considering the/each audio processing sub-operation 202 together with the other audio processing sub-operations 202, instead of individually). In this way, changes made to values of control settings of one audio processing sub-operation 202 do not feedback into changes to be made to value of control settings for other audio processing sub-operations 202.

Hence, at a step S530, n-tuples of test-values for the control settings of all of the second order filter section audio processing sub-operations 202 are identified. This is performed in a similar manner to the step S506, but when considering the entire set of control settings for all of the audio processing sub-operations 202, instead of the control settings for a single audio processing sub-operation 202. In this way, all possible values of a control setting without modification by its δ-value or with an increment or a decrement by its δ-value are tried in combination with the analogous possible values for the other control settings across all of the second order filter section audio processing sub-operations 202.

At a step S532, each of the identified n-tuples of values for the control settings is tested. In particular, for each n-tuple: (a) corresponding values for the configuration parameters for the/each audio processing sub-operation 202 are determined as a function of the respective control settings; (b) the frequency response of the resulting audio processing operation 200 is calculated (by methods well known in this field of technology); and (c) a difference between the calculated frequency response and the target frequency response is calculated (in the same way as described above for the step S508).

At a step S534, the n-tuple which led to the smallest calculated difference/error is chosen and the control settings for the/each second order filter section audio processing sub-operation 202 are set to the corresponding values from this n-tuple. This ends the processing for the step S522.

It will be appreciated that the optimization process described above with reference to FIGS. 5*a* and 5*b* is merely one example optimization process and that other techniques of adjusting one or more of the control settings so as to reduce the difference between the target frequency response and the frequency response of the resulting audio processing operation 200 may be used. However, as mentioned, the optimization procedures used preferably (a) work on control settings (local, monotonic and proportional) and (b) measure the difference between the target frequency response and the frequency response of the resulting audio processing operation 200 in the log-frequency vs amplitude domain or in the log-frequency vs log-amplitude domain.

Whilst the above embodiments of the invention have been described with reference to reducing the difference between frequency responses, it will be appreciated that analogous processing could be performed based on phase responses instead (i.e. the optimization process may operate on the control settings so as to reduce a difference between a target phase response and the phase response of the resulting audio processing operation 200).

Moreover, some embodiments may be arranged to consider both frequency responses and phase responses. In such an embodiment, for any particular n-tuple (identified at the step S506 or S532): (a) a first difference between a target frequency response and the frequency response of the resulting audio processing operation 200 may be determined; (b) a second difference between a target phase response and the phase response of the resulting audio processing operation 200 may be determined; and (c) the difference/error for this n-tuple may be a weighted sum of the first and second differences.

It will be appreciated that embodiments of the invention may be implemented using a variety of different information processing systems. In particular, although FIG. 1 and the discussion thereof provide an exemplary computing architecture and computer, this is presented merely to provide a useful reference in discussing various aspects of the invention. Of course, the description of the architecture has been simplified for purposes of discussion, and it is just one of many different types of architecture that may be used for embodiments of the invention. It will be appreciated that the boundaries between logic blocks are merely illustrative and that alternative embodiments may merge logic blocks or elements, or may impose an alternate decomposition of functionality upon various logic blocks or elements.

As described above, the system 100 comprises a computer 102. The computer 102 may be a personal computer system, a mainframe, a minicomputer, a server, a workstation, a notepad, a personal digital assistant, or a mobile telephone, or, indeed, any other computing platform suitable for executing embodiments of the invention.

It will be appreciated that, insofar as embodiments of the invention are implemented by a computer program, then a storage medium and a transmission medium carrying the computer program form aspects of the invention. The computer program may have one or more program instructions, or program code, which, when executed by a computer carries out an embodiment of the invention. The term "program," as used herein, may be a sequence of instructions designed for execution on a computer system, and may include a subroutine, a function, a procedure, an object method, an object implementation, an executable application, an applet, a servlet, source code, object code, a shared library, a dynamic linked library, and/or other sequences of instructions designed for execution on a computer system. The storage medium may be a magnetic disc (such as a hard drive or a floppy disc), an optical disc (such as a CD-ROM, a DVD-ROM or a BluRay disc), or a memory (such as a ROM, a RAM, EEPROM, EPROM, Flash memory or a portable/removable memory device), etc. The transmission medium may be a communications signal, a data broadcast, a communications link between two or more computers over a network, etc.

The invention claimed is:

1. A computer-implemented method of determining a configuration for an audio processing operation, wherein the audio processing operation comprises a predetermined set of one or more audio processing sub-operations, each audio processing sub-operation being configurable with one or more respective configuration parameters, the method comprising:

specifying the predetermined set of one or more audio processing sub-operations;

specifying a target frequency response; and performing a convergent optimization process to determine a configuration for the audio processing operation that reduces a difference between the frequency response of the audio processing operation and the target frequency response, wherein the configuration comprises a respective value for each configuration parameter of each audio processing sub-operation;

wherein the convergent optimization process comprises a plurality of iterations for reducing a difference between the frequency response of the audio processing operation and the target frequency response, wherein performing the convergent optimization process comprises:

for an audio processing sub-operation, at each iteration identifying, for one or more control settings related to that audio processing sub-operation, a corresponding value from a plurality of test values identified for that control setting for that iteration; and determining each configuration parameter of that audio processing sub-operation as a respective function of at least one of the one or more control settings related to that audio processing sub-operation;

wherein, for the or each control setting, one or more of the following apply:

(a) a change in the frequency response of the respective audio processing sub-operation caused by adjusting that control setting is monotonically related to the adjustment of that control setting;

(b) adjusting that control setting causes a substantially localized change in the frequency response of the respective audio processing sub-operation;

(c) the magnitude of a change in the frequency response of the respective audio processing sub-operation caused by adjusting that control setting is substantially proportional to the magnitude of the adjustment of that control setting.

2. The method of claim 1 in which specifying the target frequency response comprises:

specifying a plurality of initial frequency responses; and combining the initial frequency responses to form the target frequency response.

3. The method of claim 2 in which specifying a plurality of initial frequency responses comprises one or more of:

(a) measuring a frequency response of an audio device or of a room and using the measured frequency response as an initial frequency response;

(b) measuring a frequency response of an audio device or of a room and using an inverse of the measured frequency response as an initial frequency response;

(c) using a predetermined frequency response as an initial frequency response;

(d) allowing a user to modify a curve representing a frequency response to define a desired frequency response and using the desired frequency response as an initial frequency response; and (e) using the frequency response of an audio equalizer or of a combination of a plurality of audio equalizers as an initial frequency response.

4. The method of claim 2 in which combining the initial frequency responses to form the target frequency response comprises one or more of:

weighting one or more of the initial frequency responses;

adding at least two initial frequency responses;

subtracting one initial frequency response from another initial frequency response; and using the frequency response defined by one initial frequency response over a first range of frequencies and using the frequency response defined by another initial frequency response over a second range of frequencies.

5. The method of claim 1 in which the specified target frequency response is independent of the predetermined set of one or more audio processing sub-operations.

6. The method of claim 1 in which a control setting corresponds to an audio filter property adjustable by operation of an audio equalizer.

7. The method of claim 1 comprising, after performing the convergent optimization process:

allowing a user to modify the target frequency response; and performing the convergent optimization process based on the modified target frequency response.

8. The method of claim 1 in which one of the one or more audio processing sub-operations is an overall gain adjustment.

9. The method of claim 1 in which one or more of the one or more audio processing sub-operations are filter sections.

10. The method of claim 9 in which the or each filter section is a second-order filter section having four configuration parameters and a predetermined overall gain.

11. The method of claim 1 comprising:

receiving input audio data;

processing the input audio data using the audio processing operation configured according to the determined configuration; and outputting the processed input audio data.

12. The method of claim 11 comprising, whilst performing the steps of receiving, processing and outputting:

specifying a new target frequency response; and performing the convergent optimization process to determine a new configuration for the audio processing operation based on the new target frequency response, wherein the step of processing is then arranged to make use of the new configuration.

13. The method of claim 1, in which the difference between the frequency response of the audio processing operation and the target frequency response is a root-mean-squared error.

14. The method of claim 1, in which the difference between the frequency response of the audio processing operation and the target frequency response is measured over a user-defined set of frequencies.

15. A computer-implemented method of determining a configuration for an audio processing operation, wherein the audio processing operation comprises a predetermined set of one or more audio processing sub-operations, each audio processing sub-operation being configurable with one or more respective configuration parameters, the method comprising:

specifying the predetermined set of one or more audio processing sub-operations;

specifying a target phase response; and performing a convergent optimization process to determine a configuration for the audio processing operation that reduces a difference between the phase response of the audio processing operation and the target phase response, wherein the configuration comprises a respective value for each configuration parameter of each audio processing sub-operation;

wherein the convergent optimization process comprises a plurality of iterations for reducing a difference between the phase response of the audio processing operation and the target phase response, wherein performing the convergent optimization process comprises:

for an audio processing sub-operation, at each iteration identifying, for one or more control settings related to that audio processing sub-operation, a corresponding value from a plurality of test values identified for that control setting for that iteration; and determining each configuration parameter of that audio processing sub-operation as a respective function of at least one of the one or more control settings related to that audio processing sub-operation;

wherein, for the or each control setting, one or more of the following apply:

(a) a change in the phase response of the respective audio processing sub-operation caused by adjusting that control setting is monotonically related to the adjustment of that control setting;

(b) adjusting that control setting causes a substantially localized change in the phase response of the respective audio processing sub-operation;

(c) the magnitude of a change in the phase response of the respective audio processing sub-operation caused by adjusting that control setting is substantially proportional to the magnitude of the adjustment of that control setting.

16. A computer-implemented method of determining a configuration for an audio processing operation, wherein the audio processing operation comprises a predetermined set of one or more audio processing sub-operations, each audio processing sub-operation being configurable with one or more respective configuration parameters, the method comprising:

specifying the predetermined set of one or more audio processing sub-operations;

specifying a target frequency response;

specifying a target phase response; and performing a convergent optimization process to determine a configuration for the audio processing operation that reduces (a) a difference between the frequency response of the audio processing operation and the target frequency response and (b) a difference between the phase response of the audio processing operation and the target phase response, wherein the configuration comprises a respective value for each configuration parameter of each audio processing sub-operation;

wherein the convergent optimization process comprises a plurality of iterations for reducing (a) a difference between the frequency response of the audio processing operation and the target frequency response and (b) a difference between the phase response of the audio processing operation and the target phase response, wherein performing the convergent optimization process comprises:

for an audio processing sub-operation, at each iteration identifying, for one or more control settings related to that audio processing sub-operation, a corresponding value from a plurality of test values identified for that control setting for that iteration; and determining each configuration parameter of that audio processing sub-operation as a respective function of at least one of the one or more control settings related to that audio processing sub-operation;

wherein, for the or each control setting, one or more of the following apply:

(a) a change in the frequency response and a change in the phase response of the respective audio processing sub-operation caused by adjusting that control setting are monotonically related to the adjustment of that control setting;

(b) adjusting that control setting causes a substantially localized change in the frequency response of the respective audio processing sub-operation and a substantially localized change in the phase response of the respective audio processing sub-operation;

(c) the magnitude of a change in the frequency response of the respective audio processing sub-operation and the magnitude of a change in the phase response of the respective audio processing sub-operation caused by adjusting that control setting are substantially proportional to the magnitude of the adjustment of that control setting.

17. A method of configuring a target device, the target device comprising an audio processing operation, wherein the audio processing operation comprises a predetermined set of one or more audio processing sub-operations, each audio processing sub-operation being configurable with one or more respective configuration parameters, the method comprising:

determining a configuration for the audio processing operation using a method according to claim 1; and applying the determined configuration to the audio processing operation of the target device.

18. An apparatus arranged to determine a configuration for an audio processing operation, wherein the audio processing operation comprises a predetermined set of one or more audio processing sub-operations, each audio processing sub-operation being configurable with one or more respective configuration parameters, the apparatus comprising a processor arranged to:

specify the predetermined set of one or more audio processing sub-operations;

specify a target frequency response; and perform a convergent optimization process to determine a configuration for the audio processing operation that reduces a difference between the frequency response of the audio processing operation and the target frequency response, wherein the configuration comprises a respective value for each configuration parameter of each audio processing sub-operation;

wherein the convergent optimization process comprises a plurality of iterations for reducing a difference between the frequency response of the audio processing operation and the target frequency response, wherein the processor is arranged perform the convergent optimization process by:

for an audio processing sub-operation, at each iteration identifying, for one or more control settings related to that audio processing sub-operation, a corresponding value from a plurality of test values identified for that control setting for that iteration; and determining each configuration parameter of that audio processing sub-operation as a respective function of at least one of the one or more control settings related to that audio processing sub-operation;

wherein, for the or each control setting, one or more of the following apply:

(a) a change in the frequency response of the respective audio processing sub-operation caused by adjusting that control setting is monotonically related to the adjustment of that control setting;

(b) adjusting that control setting causes a substantially localized change in the frequency response of the respective audio processing sub-operation;

(c) the magnitude of a change in the frequency response of the respective audio processing sub-operation caused by adjusting that control setting is substantially proportional to the magnitude of the adjustment of that control setting.

19. A tangible non-transitory data carrying medium carrying a computer program which, when executed by a processor, causes the processor to carry out a method of determining a configuration for an audio processing operation, wherein the audio processing operation comprises a predetermined set of one or more audio processing sub-operations, each audio processing sub-operation being configurable with one or more respective configuration parameters, the method comprising:

specifying the predetermined set of one or more audio processing sub-operations;

specifying a target frequency response; and performing a convergent optimization process to determine a configuration for the audio processing operation that reduces a difference between the frequency response of the audio processing operation and the target frequency response, wherein the configuration comprises a respective value for each configuration parameter of each audio processing sub-operation;

wherein the convergent optimization process comprises a plurality of iterations for reducing a difference between the frequency response of the audio processing operation and the target frequency response, wherein performing the convergent optimization process comprises:

for an audio processing sub-operation, at each iteration identifying, for one or more control settings related to that audio processing sub-operation, a corresponding value from a plurality of test values identified for that control setting for that iteration; and determining each configuration parameter of that audio processing sub-operation as a respective function of at least one of the one or more control settings related to that audio processing sub-operation;

wherein, for the or each control setting, one or more of the following apply:

(a) a change in the frequency response of the respective audio processing sub-operation caused by adjusting that control setting is monotonically related to the adjustment of that control setting;

(b) adjusting that control setting causes a substantially localized change in the frequency response of the respective audio processing sub-operation;

(c) the magnitude of a change in the frequency response of the respective audio processing sub-operation caused by adjusting that control setting is substantially proportional to the magnitude of the adjustment of that control setting.

20. The method of claim 1, wherein for a control setting for an audio processing sub-operation, the plurality of test values identified for that control setting for an iteration is based, at least in part, on a current value for that control setting for that audio processing sub-operation.

21. The method of claim 1, wherein for a control setting for an audio processing sub-operation, an amount by which that control setting can be changed reduces from a current iteration to a next iteration in the plurality of iterations.

* * * * *